US010836014B2

(12) United States Patent
Katayama et al.

(10) Patent No.: US 10,836,014 B2
(45) Date of Patent: Nov. 17, 2020

(54) ANNULAR GRINDING STONE

(71) Applicant: DISCO CORPORATION, Tokyo (JP)

(72) Inventors: Atsuyoshi Katayama, Tokyo (JP); Takeshi Onodera, Tokyo (JP); Yoshinori Yaguchi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 343 days.

(21) Appl. No.: 16/015,775

(22) Filed: Jun. 22, 2018

(65) Prior Publication Data

US 2019/0001466 A1 Jan. 3, 2019

(30) Foreign Application Priority Data

Jun. 28, 2017 (JP) ..... 2017-126532

(51) Int. Cl.
*B24D 5/12* (2006.01)

(52) U.S. Cl.
CPC ..... *B24D 5/12* (2013.01)

(58) Field of Classification Search
CPC ..... B24D 5/12; B24D 5/06; B24D 18/0054; B28D 1/121; B23D 61/021; B23D 61/028
See application file for complete search history.

(56) References Cited

U.S. PATENT DOCUMENTS 5,285,768 A * 2/1994 Messina ..... B23D 61/021 125/15
9,227,342 B2 * 1/2016 Hoang ..... B24D 5/12
2003/0019489 A1 * 1/2003 Ogata ..... B24D 5/12 125/15
2010/0307473 A1 * 12/2010 Lee ..... B23D 61/04 125/15
2015/0056901 A1 * 2/2015 Aoki ..... B23D 61/04 451/542

FOREIGN PATENT DOCUMENTS

JP 2000087282 A 3/2000

* cited by examiner

*Primary Examiner* — Dung Van Nguyen
(74) *Attorney, Agent, or Firm* — Greer Burns & Crain Ltd.

(57) ABSTRACT

An annular grinding stone is provided which includes a cutting edge with a plurality of V-shaped slits defined in an outer circumferential portion thereof is provided. Each of the V-shaped slits is defined by a first surface and a second surface of the annular cutting edge. The first surface is positioned rearwardly of the second surface with respect to a direction along which the annular grinding stone rotates, and the second surface is positioned forwardly of the first surface with respect to the direction along which the annular grinding stone rotates. The first surface lies perpendicularly to the direction along which the annular grinding stone rotates at a radially outer end thereof and parallel to thicknesswise directions of the annular cutting edge. The second surface is inclined with respect to the first surface at an angle ranging from 30° to 60°.

2 Claims, 3 Drawing Sheets

ANNULAR GRINDING STONE

BACKGROUND OF THE INVENTION

Field of the Invention

The present invention relates to an annular grinding stone for use as a cutting blade in a cutting apparatus.

Description of the Related Art

Wafers, each substantially in the form of a circular plate made of a semiconductor, have a face side demarcated into a plurality of areas by a grid of projected dicing lines, and devices such as integrated circuits (ICs) or the like are formed in the respective demarcated areas. The wafers are finally divided along the projected dicing lines into individual device chips, which will be used in electronic equipment. In recent years, as efforts have been made to make the electronic equipment which incorporates such device chips smaller and thinner, there have been growing demands for smaller and thinner device chips for use in electronic equipment. For fabricating thinner device chips from a wafer, the reverse side of the wafer with a plurality of devices formed on its face side is ground to thin the wafer to a predetermined thickness, after which the wafer is divided into device chips along projected dicing lines on the face side of the wafer.

The wafer is divided into the device chips on a cutting apparatus equipped with an annular grinding stone or cutting blade that has an annular cutting edge. The annular grinding stone may be a hub blade having a nickel layer dispersed with diamond particles and electrodeposited on an aluminum base, for example (see Japanese Patent Laid-Open No. 2000-87282). The annular grinding stone may have a plurality of slits defined in the outer periphery of the cutting edge in order to discharge chips produced from a workpiece such as a wafer or the like when it is processed by the annular grinding stone and also to supply a cutting fluid to a processing point where the workpiece is processed by the annular grinding stone for a high cooling effect.

SUMMARY OF THE INVENTION

The slits are formed by removing portions of the outer periphery of the cutting edge of the annular grinding stone. If more portions of the outer periphery of the cutting edge are removed to form the slits, then the proportion of regions of the entire outer periphery of the annular grinding stone which are instrumental in performing the cutting action of the annular grinding stone is reduced, resulting in a reduction in the processing efficiency. Furthermore, the cutting edge stock that is removed may be so large that the mechanical strength of the annular grinding stone becomes too small to perform an appropriate cutting process. For example, if the mechanical strength of the annular grinding stone is not enough, the annular grinding stone tends to undulate or distort upon rotation, and is likely to move along a meandering path in the workpiece.

It is therefore an object of the present invention to provide an annular grinding stone which has an increased ability to discharge chips produced from a workpiece cut thereby and which provides an increased cooling effect on a processing point where the workpiece is processed by the annular grinding stone, while keeping at high levels the processing efficiency of a cutting process performed by the annular grinding stone and the mechanical strength of the annular grinding stone.

In accordance with an aspect of the present invention, there is provided an annular grinding stone for use in a cutting apparatus, including an annular cutting edge made of abrasive grains fixed in position by metal. The annular cutting edge has a plurality of V-shaped slits defined in an outer circumferential portion thereof, each of the V-shaped slits extending continuously from one side surface of the annular cutting edge to an other side surface thereof. Each of the V-shaped slits is defined by a first surface and a second surface of the annular cutting edge, the first surface being positioned rearwardly of the second surface with respect to a direction along which the annular grinding stone rotates in the cutting apparatus, and the second surface being positioned forwardly of the first surface with respect to the direction along which the annular grinding stone rotates in the cutting apparatus. The first surface lies perpendicularly to the direction along which the annular grinding stone rotates at a radially outer end thereof and parallel to thicknesswise directions of the annular cutting edge. The second surface is inclined with respect to the first surface at an angle ranging from 30° to 60°.

The annular grinding stone according to the aspect of the present invention has the V-shaped slits defined in the outer circumferential portion thereof. Each of the V-shaped slits is defined by the first surface and the second surface of the annular cutting edge, the first surface being positioned rearwardly of the second surface with respect to a direction along which the annular grinding stone rotates in the cutting apparatus, and the second surface being positioned forwardly of the first surface with respect to the direction along which the annular grinding stone rotates in the cutting apparatus. The first surface lies perpendicularly to the direction along which the annular grinding stone rotates at the radially outer end thereof and parallel to the thicknesswise directions of the annular cutting edge. The second surface is inclined with respect to the first surface at the angle ranging from 30° to 60°. The first surface is oriented in such a direction as to enable the cutting edge to contact and cut effectively into the workpiece when the annular grinding stone cuts the workpiece. The second surface is oriented in such a direction with respect to the first surface as to provide a space suitable for discharging chips and supplying a cutting fluid between the cutting edge and the workpiece, and also to give the annular grinding stone a sufficient cutting capability and a required mechanical strength. According to the aspect of the present invention, therefore, there is provided an annular grinding stone which has an increased ability to discharge chips produced from a workpiece cut thereby and which provides an increased cooling effect on a processing point where the workpiece is processed by the annular grinding stone, while keeping at high levels the processing efficiency of a cutting process performed by the annular grinding stone and the mechanical strength of the annular grinding stone.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
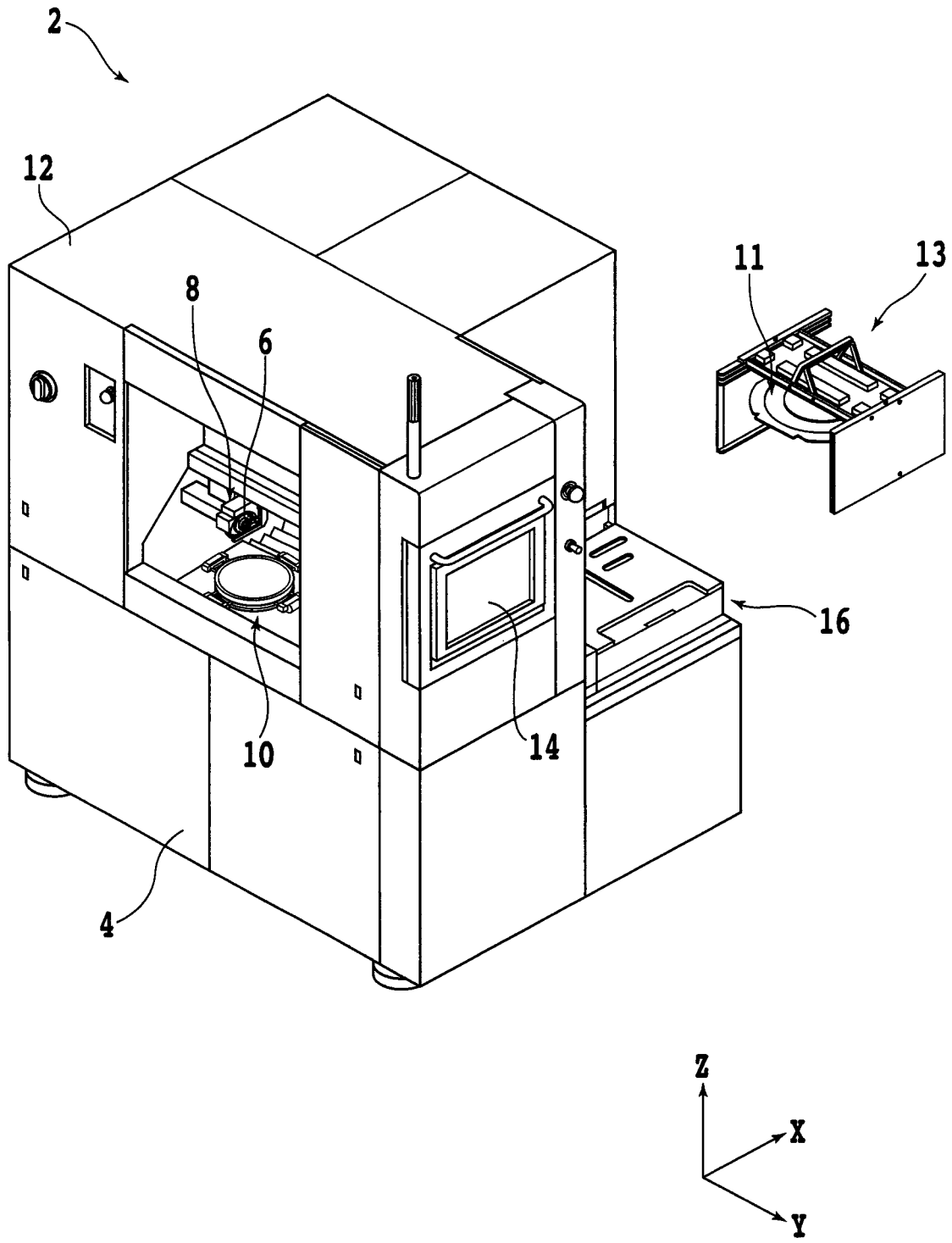
FIG. 1 is a perspective view schematically depicting a cutting apparatus.

An annular grinding stone according to an embodiment of the present invention will be described in detail below with reference to the drawings. FIG. 1 schematically depicts in perspective a cutting apparatus 2 for cutting a workpiece such as a wafer of the like, the cutting apparatus 2 incorporating the annular grinding stone according to the present embodiment. As depicted in FIG. 1, the cutting apparatus 2 includes a main housing 4 accommodating therein a cutting unit 8 that is equipped with the annular grinding stone or cutting blade, denoted by 6, according to the present embodiment. The cutting apparatus 2 includes a holding table 10 for holding a workpiece thereon, disposed below the cutting unit 8. The main housing 4 includes an outer covering 12 that extends around the cutting apparatus 2 and which has a front wall with a touch-panel display monitor 14 mounted thereon. The touch-panel display monitor 14 displays operation status details of the cutting apparatus 2. The operator of the cutting apparatus 2 can enter commands for the cutting apparatus 2 through the touch-panel display monitor 14. A rest table 16 for placing thereon a cassette 13 that houses a plurality of workpieces 11 therein is disposed in a corner of the main housing 4 of the cutting apparatus 2. The rest table 16 is vertically movable to position the cassette 13 at a predetermined height for loading a workpiece 11 into and unloading a workpiece 11 out of the cutting apparatus 2.

Each of the workpieces 11 has a plurality of intersecting projected dicing lines or streets established on a face side thereof and demarcating the face side into a plurality of areas where devices such as ICs or the like are formed. When the workpiece 11 is cut along the projected dicing lines by the cutting apparatus 2, the workpiece 11 is divided into individual device chips carrying the respective devices. A dicing tape mounted on an annular frame is stuck to the reverse side of the workpiece 11. The workpiece 11 is handled as a frame unit wherein it is integrally combined with the annular frame and the dicing tape. When the cassette 13 with the workpieces 11 housed therein is placed on the rest table 16, a feed mechanism, not depicted, in the cutting apparatus 2 unloads one of the workpieces 11 from the cassette 13 and places the unloaded workpiece 11 onto the holding table 10. The holding table 10 holds the workpiece 11 thereon under a vacuum pressure applied from a suction source, not depicted. For cutting the workpiece 11, the cutting unit 8 is set to a predetermined vertical position, and the holding table 10 is processing-fed in an X-axis direction. The annular grinding stone or cutting blade 6 on the cutting unit 8 is rotated about its own axis and caused to cut into the workpiece 11, thereby cutting the workpiece 11. The cutting unit 8 is movable in a Y-axis direction perpendicular to the X-axis direction, and is indexing-fed in the Y-axis direction after the annular grinding stone 6 has cut the workpiece 11 all the way along one projected dicing line.

Figure 2:
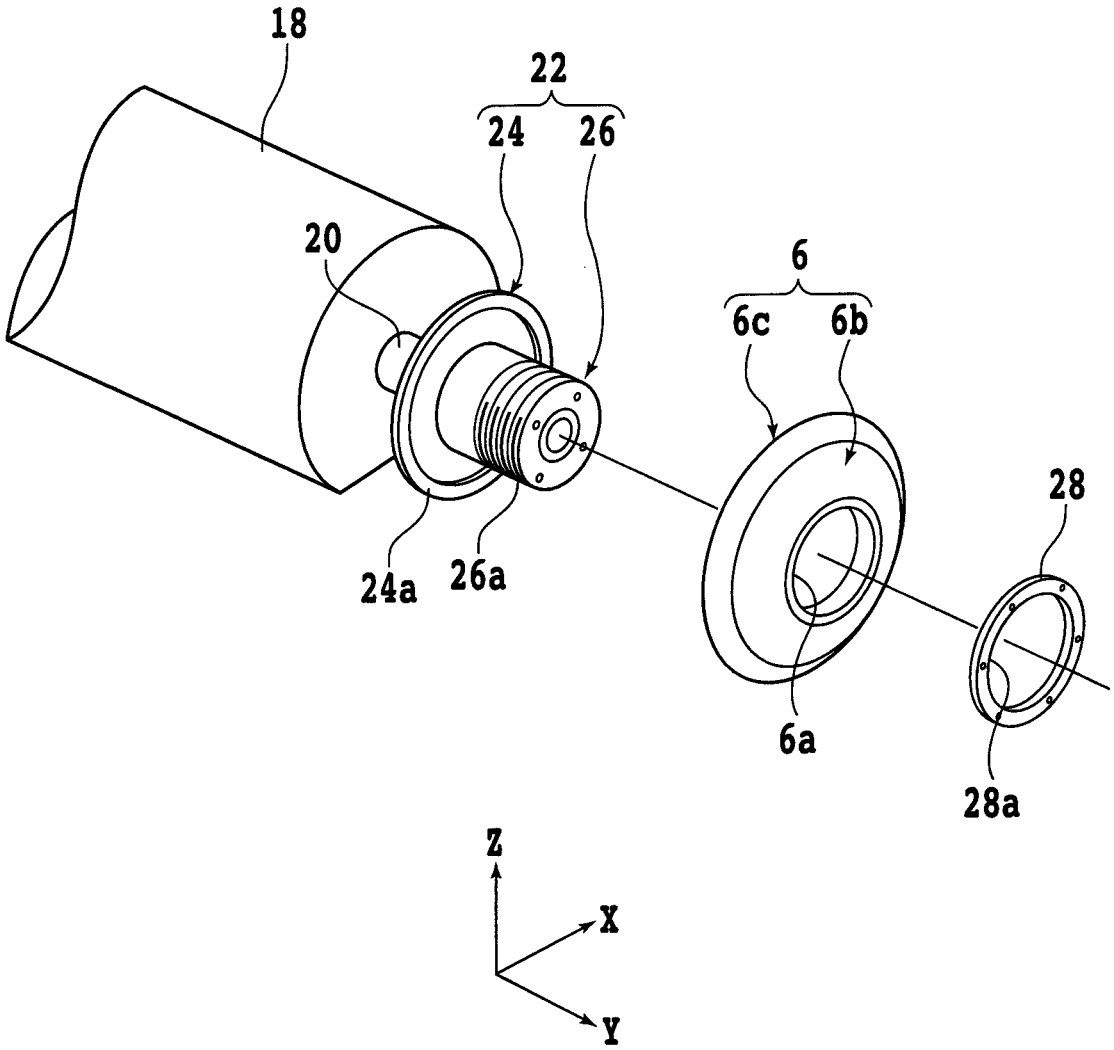
FIG. 2 is an exploded perspective view schematically depicting the structure of a cutting unit.

Structural details of the cutting unit 8 will be described below with reference to FIG. 2. FIG. 2 depicts the structure of the cutting unit 8 in exploded perspective. As depicted in FIG. 2, the cutting unit 8 includes a spindle housing 18 fixed to a moving mechanism, not depicted, in the cutting apparatus 2, for example. A spindle 20 that extends in Y-axis directions is rotatably supported in the spindle housing 18, and has a front distal end projecting forwardly from the spindle housing 18. The rear end of the spindle 20 is coupled to an electric motor disposed in the spindle housing 18. A rear flange assembly 22 is mounted on the front distal end of the spindle 20. The rear flange assembly 22 includes a flange 24 extending radially outwardly and a boss 26 projecting axially forwardly from a front surface of the flange 24. The flange 24 has an abutment surface **24*a* on an outer peripheral side portion thereof for abutment against a rear side surface of the annular grinding stone 6. The abutment surface 24*a* is of an annular shape as viewed along axial directions of the spindle 20, i.e., the Y-axis directions. The boss 26 is of a hollow cylindrical shape and has an externally threaded outer circumferential surface 26*a***.

The annular grinding stone 6 has a circular opening **6*a* defined centrally therein for receiving the boss 26 inserted therein. When the boss 26 is inserted in the opening 6*a*, the annular grinding stone 6 is mounted on the rear flange assembly 22. When an annular mounting nut 28 is threaded and tightened over the externally threaded outer circumferential surface 26*a* of the boss 26, the annular grinding stone 6 is gripped between the annular mounting nut 28 and the rear flange assembly 22, and hence is mounted in place on the cutting unit 8. The mounting nut 28 has an opening 28*a* defined therein by an inner wall surface thereof that is internally threaded for threaded engagement with the externally threaded outer circumferential surface 26*a* of the boss 26**.

Figure 3A:
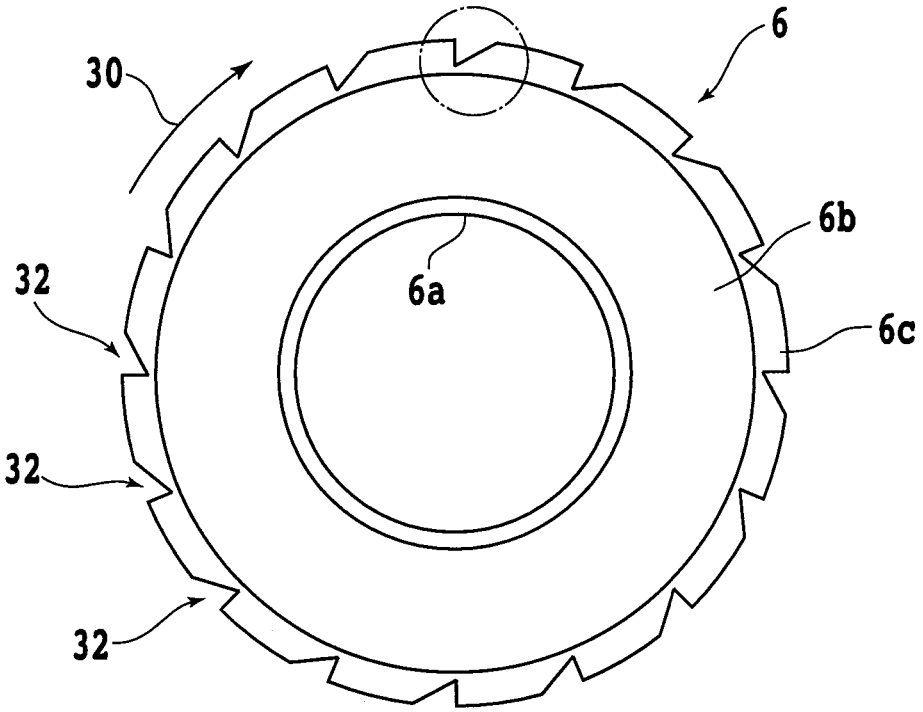
FIG. 3A is a side elevational view schematically depicting an annular grinding stone according to an embodiment of the present invention.

The annular grinding stone 6 will be described in detail below. As depicted in FIG. 2, the annular grinding stone 6 includes an annular aluminum base **6*b* with a circular opening 6*a* defined centrally therein and an annular cutting edge 6*c* made of abrasive grains fixed in position by metal to an outer circumferential surface of the annular aluminum base 6*b*. FIG. 3A schematically depicts in side elevation the annular grinding stone 6** according to the present embodiment.

Figure 3B:
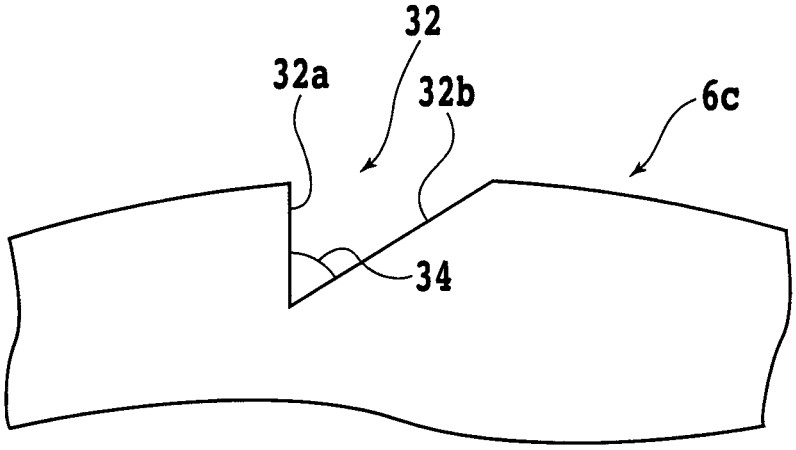
FIG. 3B is an enlarged fragmentary side elevational view schematically depicting the annular grinding stone.

As depicted in FIG. 3A, the annular grinding stone 6 has the central circular opening **6*a* through which the boss 26 is to extend. As described above, the annular grinding stone 6 includes the annular aluminum base 6*b* with the circular opening 6*a* defined centrally therein and the annular cutting edge 6*c* disposed on the outer circumferential surface of the annular aluminum base 6*b*. When the spindle 20 rotates about its own axis, the annular grinding stone 6 fixedly mounted on the cutting unit 8 rotates about its own axis. When the cutting edge 6*c* of the rotating annular grinding stone 6 is brought into contact with the workpiece 11, the cutting edge 6*c* cuts the workpiece 11. The cutting edge 6*c* has a plurality of V-shaped slits 32 defined at regular intervals in an outer circumferential portion thereof. Each of the slits 32 extends continuously from one side surface of the cutting edge 6*c* to the other side surface thereof. FIG. 3B schematically depicts the cutting edge 6*c* of the annular grinding stone 6 in enlarged fragmentary side elevation. As depicted in FIGS. 3A and 3B, each of the slits 32 is defined by and between a first surface 32*a* and a second surface 32*b* of the cutting edge 6*c* that are spaced from each other in the circumferential directions of the cutting edge 6*c*. The first surface 32*a* is positioned rearwardly of the second surface 32*b* with respect to the direction indicated by an arrow 30 along which the annular grinding stone 6 rotates in the cutting apparatus 2, and the second surface 32*b* is positioned forwardly of the first surface 32*a* with respect to the direction indicated by the arrow 30. In other words, the first surface 32***a* and the second surface 32*b* are exposed in the slit 32.

The first surface 32*a* lies perpendicularly to the direction indicated by the arrow 30 at a radially outer end thereof and parallel to the thicknesswise directions of the cutting edge 6*c*. In other words, the first surface 32*a* extends parallel to a radial direction of the annular grinding stone 6. When the annular grinding stone 6 cuts the workpiece 11, the first surface 32*a* enables the cutting edge 6*c* at the first surface 32*a* to contact and cut effectively into the workpiece 11, thereby cutting the workpiece 11 efficiently. The second surface 32*b* is inclined with respect to the first surface 32*a* at an angle 34 ranging from 30° to 60°. Specifically, the second surface 32*b* is oriented in such a direction with respect to the first surface 32*a* as to provide a space suitable for discharging chips and supplying a cutting fluid between the cutting edge 6*c* and the workpiece 11, and also to give the annular grinding stone 6 a sufficient cutting capability and a required mechanical strength. If the angle 34 is smaller than 30°, then a sufficient space for discharging chips and supplying a cutting fluid cannot be provided between the cutting edge 6*c* and the workpiece 11. If the angle 34 exceeds 60°, then the cutting capability of the annular grinding stone 6 is unduly lowered, and the mechanical strength of the annular grinding stone 6 becomes smaller than a required level. The angle 34 formed between the first and second surfaces 32*a* and 32*b* of each of the V-shaped slits 32 should preferably be in the range of 40° to 60° and more preferably be in the range of 45° to 56°.

For example, the first surface 32*a* of each of the V-shaped slits 32 has a length of 2 mm in a radial direction of the annular grinding stone 6, whereas the second surface 32*b* thereof is inclined at an angle 34 of 45° with respect to the first surface 32*a*. The edge of the first surface 32*a* at the outer periphery of cutting edge 6*c* and the edge of the second surface 32*b* at the outer periphery of cutting edge 6*c* are then spaced from each other by a distance of 2 mm. The cutting edge 6*c* has 16 V-shaped slits 32, for example, which are laid out such that the cutting edge 6*c* has rotational symmetry.

An experiment was conducted to examine the relationship between angles 34 of V-shaped slits 32 defined in cutting edges 6*c* of annular grinding stones 6 and cutting processes for cutting workpieces 11 with the annular grinding stones 6. The experiment and its results will be described below. In the experiment, three annular grinding stones 6 having cutting edges 6*c* with differently shaped V-shaped slits 32 were prepared, resin substrates were cut by the annular grinding stones 6, and the sizes of burrs left in cut grooves formed in the substrates were checked. Each of the annular grinding stones 6 had 16 V-shaped slits 32 defined in the cutting edge 6*c*. In each of the annular grinding stones 6, each of the first surfaces 32*a* of the V-shaped slits 32 had a length of 2 mm in a radial direction of the annular grinding stone 6. The edges of the first surfaces 32*a* at the outer peripheries of the cutting edges 6*c* of the three annular grinding stones 6 and the edges of the second surfaces 32*b* at the outer peripheries of the cutting edges 6*c* thereof were spaced from each other by different distances. Specifically, the distance in the first annular grinding stone 6 was 1 mm, the distance in the second annular grinding stone 6 was 2 mm, and the distance in the third annular grinding stone 6 was 3 mm. In other words, the angles 34 in the respective annular grinding stones 6 were 26.6°, 45°, and 56.3°.

The resin substrates were cut using the three annular grinding stones 6, and resin burrs left in cut grooves formed in the resin substrates were observed using an optical microscope. In the cutting process performed using the first annular grinding stone 6, it was confirmed that burrs were deposited at distances ranging from 0.15 to 0.20 mm from the walls of the cut grooves. In the cutting process performed using the second annular grinding stone 6, it was confirmed that burrs were deposited at distances ranging from 0.05 to 0.07 mm from the walls of the cut grooves. In the cutting process performed using the third annular grinding stone 6, it was confirmed that burrs were deposited at distances ranging from 0.03 to 0.05 mm from the walls of the cut grooves. According to the experiment, it was confirmed that the resin burrs left in the processed grooves by the cutting processes performed using the second and third annular grinding stones 6 were much less than the resin burrs left in the processed grooves by the cutting process performed using the first annular grinding stone 6. According to the experiment, therefore, it was confirmed that the annular grinding stone 6 according to the present embodiment is capable of efficiently removing chips produced by a cutting process and obtaining good processed results.

According to the present embodiment, the cutting edge 6*c* is produced by fixing abrasive grains of diamond, for example, to the outer circumferential surface of the annular aluminum base 6*b* with plated metal, and then forming a plurality of V-shaped slits 32 in the fixed abrasive grains. The V-shaped slits 32 may be formed to a nicety by a wire electric discharge machining process performed on a wire electric discharge machine having a copper wire, for example.

For cutting a workpiece 11 with the cutting apparatus 2 (see FIG. 1) that includes the cutting unit 8 having the annular grinding stone 6 according to the present invention, the cassette 13 that houses workpieces 11 therein is placed on the rest table 16 of the cutting apparatus 2. Then, one of the workpieces 11 is unloaded from the cassette 13, placed onto the holding table 10, and secured to the holding table 10. Then, the electric motor housed in the spindle housing 18 and coupled to the spindle 20 is energized to rotate the spindle 20 about its own axis, thereby rotating the annular grinding stone 6. Then, the annular grinding stone 6 is positioned at a predetermined height with respect to the holding table 10. The cutting edge 6*c* of the annular grinding stone 6 is positioned in alignment with an extension of one of the projected dicing lines on the workpiece 11, so that the cutting edge 6*c* can cut the workpiece 11 along the projected dicing line that has been aligned with the cutting edge 6*c*.

Now, the holding table 10 and the cutting unit 8 are moved relatively with each other in a processing-feed direction, i.e., the X-axis direction, causing the cutting edge 6*c* of the annular grinding stone 6 to incise into and cut the workpiece 11 along the projected dicing line. After the workpiece 11 has cut along the projected dicing line, the holding table 10 is moved in an indexing-feed direction, i.e., the Y-axis direction, to bring the cutting edge 6*c* of the annular grinding stone 6 into alignment with an extension of a next projected dicing line on the workpiece 11. Then, the cutting edge 6*c* of the annular grinding stone 6 incises into and cuts the workpiece 11 along the next projected dicing line. In this manner, the cutting edge 6*c* of the annular grinding stone 6 cuts the workpiece 11 successively along the projected dicing lines that extend parallel to one direction. Thereafter, the holding table 10 is turned 90°, and the cutting edge 6*c* of the annular grinding stone 6 cuts the workpiece 11 successively along the remaining projected dicing lines of the grid of projected dicing lines. When the cutting edge 6*c* of the annular grinding stone 6 has cut the workpiece 11 along all the projected dicing lines thereon, the workpiece 11 is divided into individual device chips.

The present invention is not limited to the embodiment described above, but various changes and modifications may be made in the embodiment. For example, though the annular grinding stone according to the embodiment is illustrated as a hub blade having an aluminum base and a cutting edge, the present invention is not limited to such an annular grinding stone, but covers other types of annular grinding stones, e.g., an annular grinding stone (cutting blade) of the washer type including no base or an annular grinding stone (cutting blade) of the metal blade type with a base.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. An annular grinding stone for use in a cutting apparatus, comprising:

an annular cutting edge made of abrasive grains fixed in position by metal, wherein said annular cutting edge has a plurality of V-shaped slits defined in an outer circumferential portion thereof, each of said V-shaped slits extending continuously from one side surface of said annular cutting edge to an other side surface thereof, each of said V-shaped slits is defined by a first surface and a second surface of said annular cutting edge, said first surface being positioned rearwardly of said second surface with respect to a direction along which said annular grinding stone rotates in the cutting apparatus, and said second surface being positioned forwardly of said first surface with respect to the direction along which said annular grinding stone rotates in the cutting apparatus, said first surface lies perpendicularly to the direction along which said annular grinding stone rotates at a radially outer end thereof and parallel to thicknesswise directions of said annular cutting edge, and said second surface is inclined with respect to said first surface at an angle ranging from 30° to 60°.

2. An annular grinding stone for use in a cutting apparatus, comprising:

an annular aluminum base; and an annular cutting edge made of abrasive grains fixed in position by metal to an outer circumferential surface of said annular aluminum base, wherein said annular cutting edge has a plurality of V-shaped slits defined in an outer circumferential portion thereof, each of said V-shaped slits extending continuously from one side surface of said annular cutting edge to an other side surface thereof, each of said V-shaped slits is defined by a first surface and a second surface of said annular cutting edge, said first surface being positioned rearwardly of said second surface with respect to a direction along which said annular grinding stone rotates in the cutting apparatus, and said second surface being positioned forwardly of said first surface with respect to the direction along which said annular grinding stone rotates in the cutting apparatus, said first surface lies perpendicularly to the direction along which said annular grinding stone rotates at a radially outer end thereof and parallel to thicknesswise directions of said annular cutting edge, and said second surface is inclined with respect to said first surface at an angle ranging from 30° to 60°.

* * * * *